US006176088B1

(12) United States Patent
Vidinsky

(10) Patent No.: US 6,176,088 B1
(45) Date of Patent: Jan. 23, 2001

(54) METHOD AND DEVICES TO REDUCE VIBRATIONS IN A CRYOSTAT

(75) Inventor: Branimir Vidinsky, Glen Cove, NY (US)

(73) Assignee: EDAX, Inc., Mahwah, NJ (US)

( * ) Notice: Under 35 U.S.C. 154(b), the term of this patent shall be extended for 0 days.

(21) Appl. No.: 09/010,896

(22) Filed: Jan. 22, 1998

(51) Int. Cl.[7] ..... F25B 19/00
(52) U.S. Cl. ..... 62/51.1; 62/46.1
(58) Field of Search ..... 62/46.1, 51.1, 62/6

(56) References Cited

U.S. PATENT DOCUMENTS 2,662,379 * 12/1953 Reich ..... 62/46.3
3,069,042 * 12/1962 Johnston ..... 62/45.1
3,142,159 * 7/1964 Berlad ..... 62/46.3
3,258,602 * 6/1966 Promish ..... 62/51.1
3,302,415 * 2/1967 Royet ..... 62/46.3
3,950,960 * 4/1976 Kawam ..... 62/46.3
4,259,846 * 4/1981 Rudolphi et al. ..... 62/46.3
4,385,499 * 5/1983 Lam ..... 62/6
4,756,163 * 7/1988 Garg ..... 62/46.1

* cited by examiner

*Primary Examiner*—Ronald Capossela
(74) *Attorney, Agent, or Firm*—Armstrong Teasdale LLP

(57) ABSTRACT

A porous material inserted into a fluid-containing vessel reduces turbulence, heat transfer, and mass transfer in the fluid. The material may be used in a cryostat to reduce turbulence in a boiling cryogenic fluid. The cryostat may be used in an energy dispersive x-ray analysis unit to cool an x-ray detector.

18 Claims, 2 Drawing Sheets

METHOD AND DEVICES TO REDUCE VIBRATIONS IN A CRYOSTAT

BACKGROUND OF THE INVENTION

A. Field of the Invention

The invention relates to the field of reducing turbulence in a fluid.

B. Related Art

In the field of energy dispersive x-ray analysis, vessels known as Dewars or cryostats are commonly used to cool the x-ray detectors to cryogenic temperatures. The cryostats are commonly filled with liquid nitrogen, but can be filled with any cryogenic liquid. Due to imperfections in the insulation of the cryostats, the cryogenic liquid may boil violently. The boiling results turbulence, which leads to vibration, which in turn can cause deterioration in the resolution of the x-ray detector.

Even when the boiling is of the nucleate type, from "hot" walls of the vessel, significant turbulence may occur. "Hot" in this context is of course relative to the temperature of the cryogenic liquid.

SUMMARY OF THE INVENTION

The object of the invention is to reduce turbulence in a fluid.

The object is achieved by using a porous material in the fluid.

The invention can also be used to distribute heat transfer throughout a fluid or reduce mass transfer throughout a fluid.

BRIEF DESCRIPTION OF THE DRAWING

The invention will now be described by way of non-limitative example with reference to the following drawings.

DETAILED DESCRIPTION OF THE PREFERRED EMBODIMENTS

Figure 1:
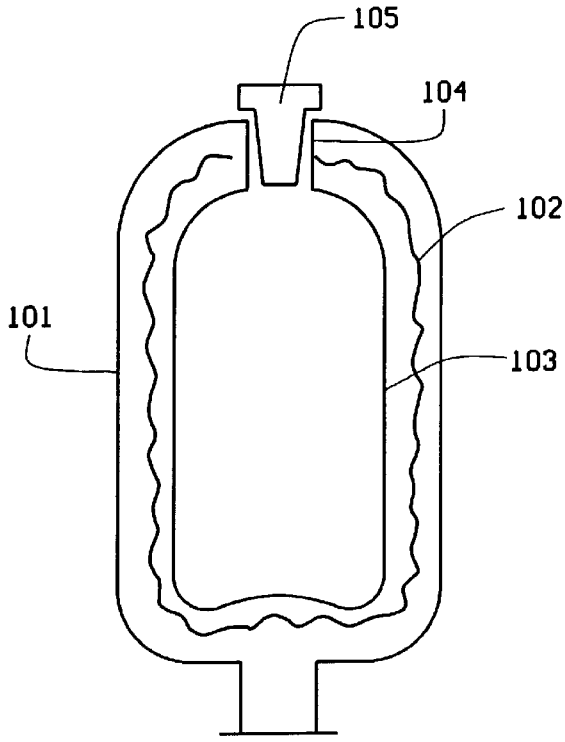
FIG. 1 PRIOR ART
FIG. 1 shows a prior art cryostat.

FIG. 1 shows a prior art cryostat. The cryostat may have any shape. The cryostat commonly has a vacuum vessel 101, insulation 102, and an inner vessel 103. There is an opening at the top called a neck 104 for filling the vessel 103 with cryogenic liquid. The cryostat is closed by a non-hermetic cap 105, which allows for continuous venting of the inner vessel.

Figure 2:
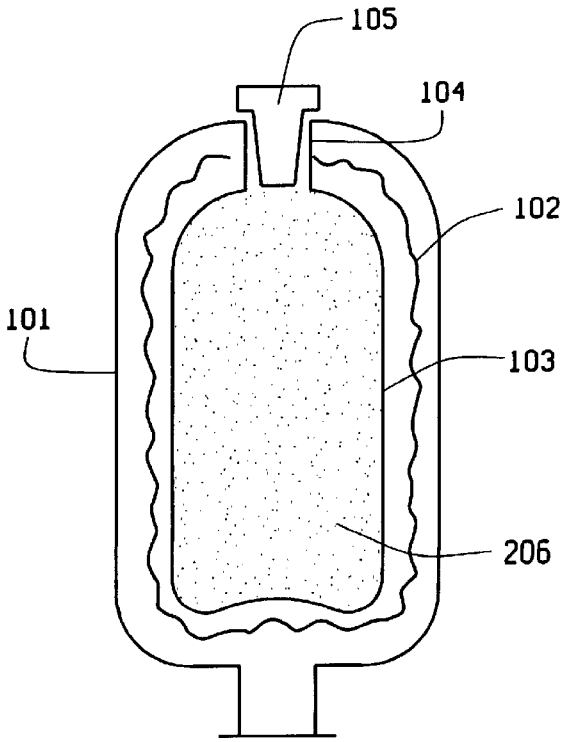
FIG. 2 shows a cryostat with hard porous material

FIG. 2 shows implementation of the invention in a cryostat. The vessel 103 is filled with a hard, porous material 206. The material is porous in the sense that it is filled with passages for the cryogenic liquid to flow through. The majority of passages must communicate with each other throughout the vessel 103 so that the fluid can access them. The passages restrict the natural circulation of the cryogenic liquid into narrow channels, changing turbulent flow to laminar or transition flow.

The material preferably occupies 20–30% of the volume of the vessel 103, with the rest of the space occupied by passages defined by the material. Conceivably the material might occupy as much as 50% of the volume of the vessel 103. The hard porous material might be of a foamed and/or sintered type. Some appropriate materials could be metals, silica compounds, ceramics or polymers, e.g. aluminum, stainless steel, or quartz. An example of a suitable foamed material would be Duocel® metal/ceramic foam available from ERG Materials & Aerospace, 900 Stanford Ave, Oakland, Calif. 94608.

Since the passages should communicate, they might be embodied in just one passage with some turns, angles and/or forks or a spiral with one long, continuous curve. The term "a plurality of passages" as used herein therefore includes the situation of one passage with such a curve, turns, angles, and/or forks.

The material 206 is preferably secured to all walls of the vessel 103 at the time the vessel is built.

Figure 3:
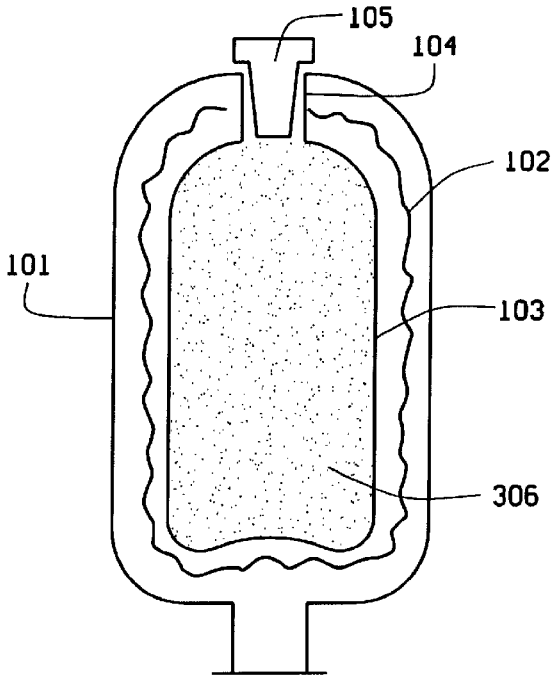
FIG. 3 Shows a cryostat with soft porous material

FIG. 3 shows an alternative embodiment of the invention. In this embodiment, a soft, porous material 306 is inserted in the vessel 103. The soft, porous material is preferably fibrous such as metal wool or silica wool. Suitable metal wools are GSS-90 Stainless Steel Fibers or GCU-340 copper fibers, both available from Global Material Technologies, Inc., 1540 E. Dundeet Road, Suite 210, Palatine, Ill. 60067, tel. 1-847-202-7000. The metal wool can be added after manufacturing of the cryostat, by simple insertion through the neck 104. After insertion, the metal wool expands to fill the vessel 103. The soft, porous material 306 is preferably not secured to the walls of the vessel 103.

Those of ordinary skill in the art will be able to devise other materials in line with the inventive concept explained herein to accomplish the function of reducing turbulence in the fluid. Also, the invention can be applied to vessels of other shapes and functions.

Figure 4:
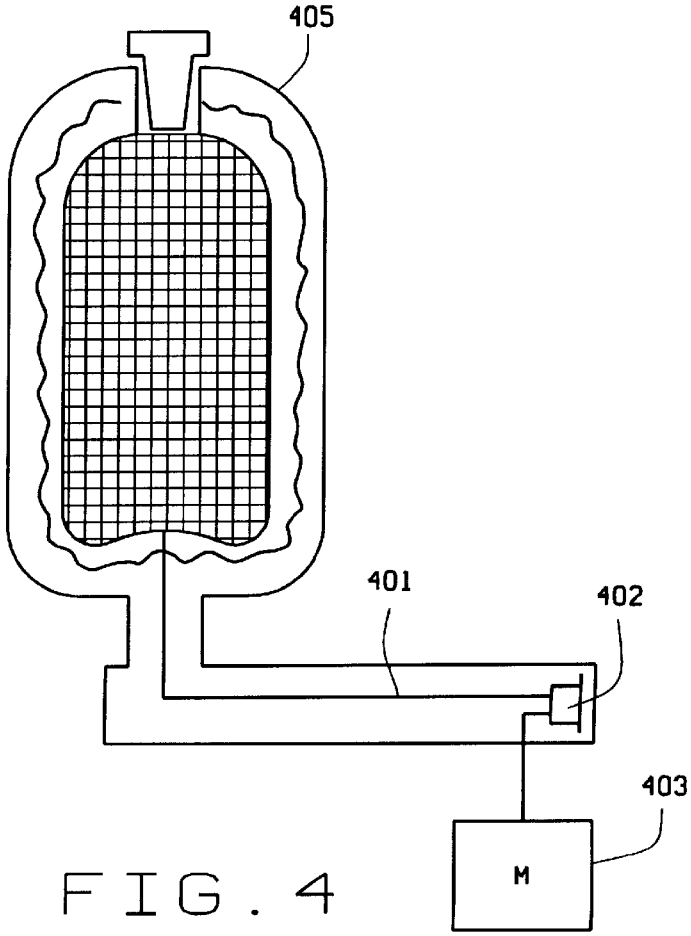
FIG. 4 shows an energy dispersive x-ray analysis unit cooled with a cryostat in accordance with FIG. 2 or FIG. 3.

FIG. 4 shows an energy dispersive x-ray analysis unit provided with the cryostat 405 of FIG. 2 or FIG. 3. The unit also includes an x-ray detector 402 cooled by the cryostat 405, cold finger 401, and processing apparatus 403. The x-ray detector may be a lithium-drifted silicon crystal. The cold finger 401 is intended to provide good thermal contact between the detector 402 and cryostat 405. The cold finger may also have means to attenuate vibrations.

I claim:

1. Apparatus configured to reduce turbulence in a cryogenic fluid, the apparatus comprising:

a vessel comprising a top and a bottom, said top comprising a first opening configured to receive a cap, said bottom comprising a second opening configured to be in flow communication with an energy dispersive x-ray analysis unit; and a material disposed within the vessel, the material defining a plurality of passages.

2. The apparatus of claim 1 wherein the material is secured to inner walls of the vessel.

3. The apparatus of claim 1 wherein the material is not secured to inner walls of the vessel.

4. The apparatus of claim 1 wherein the material is a sintered material.

5. The apparatus of claim 1 wherein the material is a foamed material.

6. The apparatus of claim 1 wherein the material is fibrous.

7. The apparatus of claim 6 wherein the material is a metal wool.

8. The apparatus of claim 7 wherein the metal wool comprises stainless steel.

9. The apparatus of claim 7 wherein the metal wool comprises copper.

10. The apparatus of claim 6 wherein the material is a silica wool.

11. The apparatus of claim 10 wherein the silica wool comprises glass.

12. The apparatus of claim 1 wherein the material comprises one or more of: a metal, a metallic compound, a silica compound, a ceramic, and a polymer.

13. A cryostat comprising an outer vacuum vessel;

insulation; and an apparatus comprising a vessel disposed within said outer vacuum vessel and a material disposed within said apparatus vessel, said apparatus vessel comprising a top and a bottom, said top comprising a first opening configured to receive a cap, said bottom comprising a second opening configured to be in flow communication with an energy dispersive x-ray analysis unit, said material defining a plurality of passages, said insulation disposed between said outer vacuum vessel and said apparatus vessel.

14. The cryostat of claim 13 wherein the material is one of: a foamed material, a sintered material, and a fibrous material.

15. The cryostat of claim 13 wherein the apparatus vessel contains a cryogenic liquid, said cryostat configured to reduce turbulence within the cryogenic liquid.

16. An energy dispersive x-ray analysis unit comprising:

a cryostat comprising an outer vacuum vessel, insulation; an inner vessel, said insulation disposed between said outer vacuum vessel and said inner vessel, said inner vessel disposed within said outer vacuum vessel and comprising a top, a bottom, and a material, said top comprising a first opening configured to receive a cap, said bottom comprising a second opening, said material disposed within said inner vessel and defining a plurality of passages, said cryostat configured to reduce turbulence in a cryogenic fluid; and an x-ray detector coupled to said cryostat second opening, said cryostat configured to cool said x-ray detector.

17. The unit of claim 16 wherein the material is one of: a foamed material, a sintered material, or a fibrous material.

18. The unit of claim 16 wherein the material is one or more of: a metal, a metallic compound, a silica compound, a ceramic, and a polymer.

* * * * *